United States Patent [19]

Ellis

[11] 3,931,499

[45] Jan. 6, 1976

[54] BOWLING GAME COUNTER

[75] Inventor: Claude E. Ellis, Muskegon, Mich.

[73] Assignee: Brunswick Corporation, Skokie, Ill.

[22] Filed: May 26, 1972

[21] Appl. No.: 257,442

Related U.S. Application Data

[63] Continuation of Ser. No. 56,612, July 20, 1970, Pat. No. 3,710,080.

[52] U.S. Cl. ..... 235/92 GA; 235/92 ST; 235/92 R; 273/54 C

[51] Int. Cl.[2] ..... G06M 3/08

[58] Field of Search ..... 235/92 GA, 92 ST, 92 PD; 273/54 C

[56] References Cited

UNITED STATES PATENTS

| | | | |
|---|---|---|---|
| 2,555,405 | 6/1951 | Funk | 235/92 GA |
| 3,179,790 | 4/1965 | Torresen | 235/92 GA |
| 3,648,026 | 3/1972 | Abe et al. | 235/92 PD |

*Primary Examiner*—Joseph M. Thesz, Jr.
*Attorney, Agent, or Firm*—John G. Heimovics; Sheldon L. Epstein; David S. Guttman

[57] ABSTRACT

An apparatus for counting and indicating the number of bowling games played in a bowling establishment having a plurality of lanes, each equipped with an automatic pinsetter. A count of eleven feedback counter provides a single output signal in response to eleven frame input signals each of which may be taken from the various automatic pinsetters each time a frame is played on any one of the lanes to convert frame signals to game signals. The output signal from the counter is then fed to a totalizer indicator which indicates the number of output pulses received as indicative of the number of games played in the bowling establishment.

3 Claims, 1 Drawing Figure

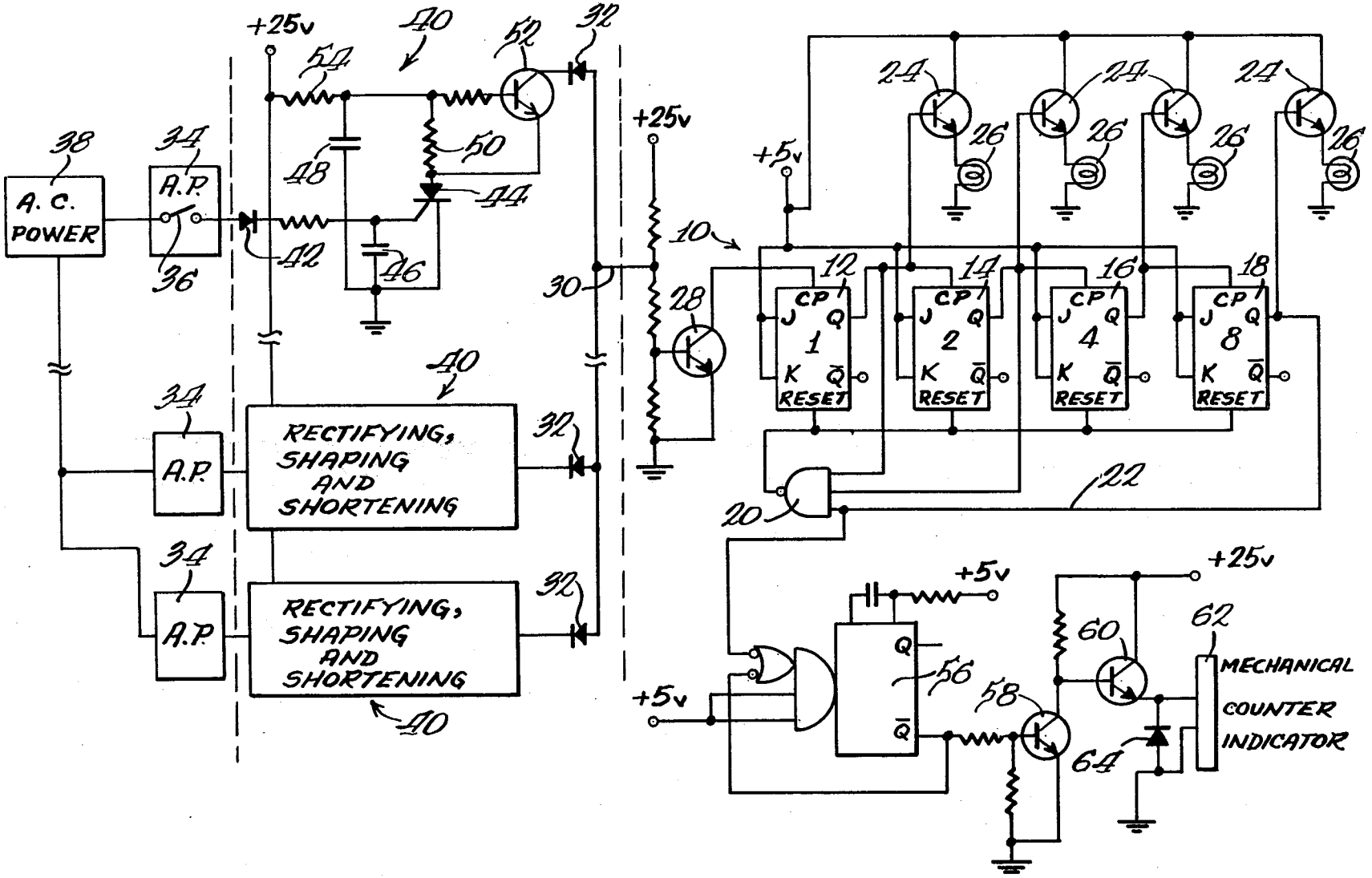
MECHANICAL COUNTER INDICATOR
RECTIFYING, SHAPING AND SHORTENING
RECTIFYING, SHAPING AND SHORTENING
A.C. POWER
A.P.
A.P.
A.P.
+25v
+5v
+25v
+5v
+5v
CP
J
K
Q
RESET
1
2
4
8

BOWLING GAME COUNTER

This is a continuation of application Ser. No. 56,612 filed July 20, 1970, now U.S. Pat. No. 3,710,080 issued Jan. 9, 1973.

BACKGROUND OF THE INVENTION

Many modern bowling lane establishments are in constant operation, 24 hours of every day. As these establishments usually have a great many bowling lanes, often 50 or more, each generally is equipped with an automatic pinsetter. The pinsetters automatically clear the lanes of bowling pins which have been knocked down after the first ball of each frame and set ten pins after each frame. It is usually very difficult for the proprietor of a modern bowling lane establishment to determine accurately the actual use his lanes receive. Even if each pinsetter is provided with an individual counter for recording the number of frames or games bowled, a substantial amount of time is required in reading each of the many counters in totaling the sum of all the counters. Obviously, an accurate up to the minute count cannot be made of the actual number of frames played on all the lanes when relying on individual counters at each pinsetter because of the time involved in making the count.

It has therefore been proposed to use a single counter indicator that would indicate the number of games played in the entire establishment. The particular approach taken fed frame signals from each pinsetter to corresponding ten position stepping switches each of which was arranged to generate one output signal each time ten frame signals had been received from an associated pinsetter. The output signals from each of the stepping switches were then fed to a single mechanical counter-indicator which accumulated the number of pulses received from each stepping switch and indicated the number of the same as indicative of the number of games played in the entire establishment based on the assumption that ten frames on each lane constituted one game.

This approach, while successful, has not been totally satisfactory due to the cost of the equipment. Specifically, the cost of providing a stepping switch for each lane is prohibitive. Furthermore, because the approach is principally an electromechanical one, reliability is not as high as desired.

SUMMARY OF THE INVENTION

It is the principal object of the invention to provide a new and improved counting and indicating device for use in counting and indicating the number of games played in bowling establishments having a plurality of lanes, each equipped with an automatic pinsetter. More specifically, it is an object of the invention to provide such a counter-indicator that eliminates many of the components heretofore believed necessary and which has improved reliability over the systems heretofore employed for the purpose.

The exemplary embodiment of the invention achieves the foregoing object through a principally electronic structure based about a single, four bit binary feedback, count by eleven counter which is adapted to provide a single game output pulse each time eleven frame pulses are received by the same. The game output pulse is fed to a one shot for shaping purposes and to provide a pulse having sufficient duration to drive a conventional mechanical counter indicator which indicates the number of games played in the establishment. Interposed between the one shot and the mechanical counter indicator is a driving network.

Input frame signals to the feedback counter are provided by a single driver connected to the output of a multiple input OR gate. The number of inputs to the OR gate correspond to the number of lanes in the establishment and each input is connected to a pulse rectifying, shaping and shortening network. The input to each network is connected to a corresponding automatic pinsetter to receive an alternating current frame signal of relatively long duration therefrom.

In operation, the alternating current signal from the automatic pinsetter is converted to a direct current signal of significantly shorter duration so as to effectively preclude frame signals from two or more lanes from reaching the feedback counter simultaneously. On the assumption that an average bowling game consists of eleven frames, the feedback counter will accumulate eleven pulses from one or more of the shaping and shortening networks and issue the aforementioned game output signal each such time eleven frame signals are received.

Other objects and advantages of the invention will become apparent from the following specification taken in conjunction with the accompanying drawing.

DESCRIPTION OF THE DRAWING

The FIGURE is a schematic view of one form of bowling game counter-indicating apparatus made according to the invention.

DESCRIPTION OF THE PREFERRED EMBODIMENT

An exemplary embodiment of a bowling game counter-indicator system made according to the invention is seen in the FIGURE and includes a binary counter, generally designated 10, formed of four bits 12, 14, 16 and 18. Each of the bits 12–18 is formed of a conventional JK flip-flop and the bits are interconnected as shown with feedback being provided by the output of a NAND gate 20.

As will be seen, the counter 10 converts frame impulses to game impulses for totalizing and indicating. More specifically, the counter 10 is adapted to issue a game output signal on line 22 whenever it has received a predetermined number of frame input signals which correspond to the number of frames in a game.

In an average bowling game, there are approximately 10.6 frames per game. The fractional frame in excess of 10 is due to the rolling of one or more bonus balls following a mark in the ten frame according to conventional rules of scoring of a bowling game promulgated by the American Bowling Congress. That is, if a bowler achieves a spare in the tenth frame, he is entitled to roll one bonus ball which, if a strike, will be an additional frame. In such a case, the bowler will have actually bowled eleven frames. If the bowler does not achieve a strike on a single bonus ball following a spare, it will still be indicated by a pinsetter to be a frame inasmuch as the pinsetter will have to be manually cycled to spot a new set of pins for the next bowler.

If a bowler were to roll a strike in the tenth frame, he is entitled to roll two bonus balls. If a strike is obtained on the first bonus ball, the bowler will effectively bowl two additional frames whereas if a strike is not obtained on the first ball, the bowler will bowl but a single additional frame. In any event, it is believed apparent from the foregoing how an average bowling game consists of more than 10 frames.

Returning to the counter 10, the feedback from the NAND gate 20 is arranged so that the counter 10 is a count by eleven counter. That is, each time 11 input pulses are received, a single output pulse will be generated. A count by eleven counter is chosen as the integer 11 most nearly approximates the average number of frames in a bowling game. However, if desired, a standard binary coded decimal four bit feedback counter could be employed, in which case, it would be assumed that there are 10 frames to an average bowling game.

Each of the bits 12–18 includes an output lead to a corresponding driving transistor 24 which is operative to drive an associated lamp 26 when the corresponding bit in the counter 10 is set. The lamps 26 provide means for monitoring both the state and the performance of the counter.

Input frame signals to the counter 10 are received from a driver 28 which is connected to apply a pulse to the first bit 12 of the counter 10 whenever a pulse appears on a line 30. The line 30 is the output of an OR gate formed by a plurality of diodes 32, one for each lane, connected in parallel, for purposes to be seen.

As mentioned previously, each time a frame is completed on a lane, a signal is generated by an automatic pinsetter operative on the lane. Conventional automatic pinsetters are indicated in block form at 34 and each includes a switch 36 connected to a source of low voltage alternating current power 38. The switch 36 will be closed each time the pinsetter 34, in its normal operation, determines that a frame has been played on that lane. The switch 36 may be of the type described in U.S. Pat. No. 2,949,300 to Huck et al and specifically, the switch referred to therein as element 619.

Each time a frame is played and the automatic pinsetter 34 determines the same, the switch 36 is momentarily closed (mechanically speaking) to issue the frame signal. Electronically speaking, the signal issued is of relatively long duration, normally having a duration of about 3 seconds.

Since the counter 10 must be operated on direct current, and since in a large bowling establishment, there is a possibility that two or more of the pinsetters 34 will issue a frame signal substantially simultaneously, in order to provide an accurate indication and avoid coincidence of frame pulses applied to the driver 28, a pulse rectifying, shaping and shortening circuit, generally designated 40, is interposed between each diode 32 and the corresponding switch 36 in the corresponding automatic pinsetter 34.

In particular, there is provided a diode 42 which serves as a half wave rectifier and which applies the positive half of the alternating current signal received from the automatic pinsetter 34 to the gate of a silicon controlled rectifier 44. Interposed between the diode 42 and the gate of the silicon controlled rectifier 44 is a capacitor 46 which serves to shunt noise signals to ground so as to preclude the silicon controlled rectifier 44 from being triggered by stray noise in the automatic pinsetter electrical circuits.

When the silicon controlled rectifier 44 is triggered by a frame signal from the automatic pinsetter 34, it begins to conduct and discharges a capacitor 48. Initially, the total voltage on the capacitor 48 will be applied across a resistor 50 and drives a transistor 52 having its collector connected to a diode 32 into saturation to ultimately provide a pulse to the counter 10. Of course, as the capacitor 48 discharges, ultimately the transistor 52 will turn off. Generally, it is desirable to select the capacitor 48 and resistor 50 to drive the transistor 52 for approximately 100 microseconds.

The circuit also includes a resistor 54 through which the capacitor 48 may be recharged. After the automatic pinsetter 34 has caused the switch 36 to open thereby eliminating any signal at the gate of the silicon controlled rectifier 44, the capacitor 48 will begin to charge through the resistor 54. Because the resistor 54 is also in circuit with the silicon controlled rectifier 44, its resistance is chosen to be extremely large so that the charging current is less than the minimum current required to keep the silicon controlled rectifier in its conducting state.

Typical values for the resistors 50 and 54 may be 130 ohms and 20 megohms respectively. The capacitor 48 may have a capacitance of 0.1 microfarads.

Each time a transistor 52 is driven into saturation, the transistor 28 is cut off to apply a positive pulse to the input of the counter 10. As mentioned previously, after 11 pulses are received, a game output signal will be issued on the line 22. This signal will, in conjunction with the NAND gate 20, reset the counter for subsequent pulses. In addition, the signal is fed to a one-shot 56 to momentarily drive the same into its unstable state. When the one-shot 56 is tripped, a transistor 58, which serves as an amplifier is turned on and in turn, turns on a transistor 60, provided for impedance matching purposes, which is connected to an electromechanical counter-indicator 62. The conduction of the transistor 60 will therefore provide a driving pulse to the mechanical counter-indicator 62. When the one-shot 56 returns to its stable state, both the transistors 58 and 60 will return to a nonconducting state.

The period of the one-shot 56 is generally selected to have a proper width sufficient to drive the mechanical counter-indicator 62. Normally, a period of about 60 milliseconds will be sufficient.

Also provided between the lines of the mechanical counter-indicator 62 is a shunting diode 64 to protect the circuit from the large electromotive force produced when the magnetic field in the counter collapses.

From the foregoing, it will be appreciated that the invention provides a new and improved bowling game counter-indicator and is significantly improved over those heretofore employed for the purpose. In particular, one single counter such as the counter 10 may service an entire establishment in contrast to the multitude of stepping switches previously employed. Furthermore, with the exception of the automatic pinsetter switch 36 and the mechanical counter indicator 62, the same is entirely electronic in nature and therefore considerably more reliable than prior art systems.

I claim:

1. An apparatus for counting the number of frames bowled upon a plurality of bowling lanes and calculating therefrom the equivalent number of games played upon all the lanes, comprising;

a plurality of first signal generating means each associated with one of a plurality of bowling lanes for generating a first electrical signal upon the completion of a frame on its associated lane, counting means comprising a plurality of electrical pulse shaping circuit means each triggered by signals from a selected one of said first signal generating means for generating a second electrical signal in response to said first signal but very substantially shorter in time duration than said first signal, means responsive to random signals from said plurality of second signal generating means for recording the number of equivalent games represented thereby, including a dividing binary counter having a single input connected to the outputs of said plurality of short signal generating circuits and operative to count frames completed on all lanes and divide the count by 11 to determine the equivalent number of completed games represented thereby.

2. An apparatus which counts the frames bowled on a plurality of bowling lanes and calculates the number of games played from this count, comprising:

a plurality of signal generators, one associated with each lane for generating an electrical signal representative of a completed frame on that lane;

a plurality of pulse generators for producing shortened electrical pulses representative of frames completed on any lane, each pulse generator being discretely connected to one of the signal generators and triggered by the signal generator's electrical signal;

a divider binary counter for counting the electrical pulses and calculating the number of completed games they represent;

an OR gate connecting the pulse generators' outputs to the counter, whereby the pulses are conducted to the counter in the order generated; and an indicator connected to the counter for displaying the number of games bowled.

3. An apparatus for counting and indicating the number of bowling games played in a bowling establishment having a plurality of lanes comprising;

a. means associated with each lane for generating a first electrical signal upon the completion of a frame, b. a plurality of pulse shortening and shaping circuits, one connected discretely to each of said first signal generating means to receive said first signal and convert the same to a signal of relatively short duration;

c. an OR gate having its input connected to each of said pulse shortening and shaping circuits and adapted to issue an output signal whenever a signal is received on any one of said pulse shortening and shaping circuits;

d. a binary feedback counter connected to receive the output signal from said pulse shortening and shaping OR gate and for issuing a single game output signal after a predetermined number of frame completed signals have been received from siad OR gate; and e. counter-indicator means connected to said binary counter and responsive to said game output signals to count and indicate the total number of games bowled upon the plurality of lanes.

* * * * *